US008955905B2

(12) United States Patent
Boenigk et al.

(10) Patent No.: US 8,955,905 B2
(45) Date of Patent: Feb. 17, 2015

(54) SEATING ASSEMBLY HAVING A SEAT-MOUNTED ATTACHMENT ASSEMBLY FOR ADJUSTABLE EXTENSION ARM

(71) Applicant: Neutral Posture, Inc., Bryan, TX (US)

(72) Inventors: Rebecca E. Boenigk, College Station, TX (US); Anthony K. Chapman, Temple, TX (US); Suzanne M. Wich, College Station, TX (US); Larry D. Johnson, Bryan, TX (US); Jerome J. Congleton, College Station, TX (US)

(73) Assignee: Neutral Posture, Inc., Bryan, TX (US)

( * ) Notice: Subject to any disclaimer, the term of this patent is extended or adjusted under 35 U.S.C. 154(b) by 13 days.

(21) Appl. No.: 13/913,246

(22) Filed: Jun. 7, 2013

(65) Prior Publication Data

US 2014/0361584 A1 Dec. 11, 2014

(51) Int. Cl.

| | |
|---|---|
| ***A47B 39/00*** | (2006.01) |
| ***A47B 39/02*** | (2006.01) |
| ***A47B 83/02*** | (2006.01) |

(52) U.S. Cl.

CPC ..... *A47B 83/02* (2013.01)
USPC ..... 297/173; 297/135; 297/170

(58) Field of Classification Search

USPC ..... 297/135, 170, 173
See application file for complete search history.

(56) References Cited

U.S. PATENT DOCUMENTS

| | | | | | |
|---|---|---|---|---|---|
| 336,220 | A | * | 2/1886 | Farrar | 297/242 |
| 564,044 | A | * | 7/1896 | Berkemeyer | 297/170 |
| 641,748 | A | * | 1/1900 | Smith | 248/124.1 |
| 3,000,606 | A | * | 9/1961 | Storm, Jr. et al. | 248/280.11 |
| 3,017,219 | A | | 6/1962 | Mallet | |
| 3,093,411 | A | | 6/1963 | Mallet | |
| 3,160,379 | A | * | 12/1964 | Gardella | 248/125.7 |
| 3,243,497 | A | * | 3/1966 | Kendall et al. | 174/61 |
| 3,311,411 | A | * | 3/1967 | Page et al. | 297/170 |
| 3,336,076 | A | | 8/1967 | Malitte | |
| 3,755,899 | A | * | 9/1973 | Betush | 433/28 |
| 3,771,226 | A | * | 11/1973 | Lieb et al. | 433/33 |

(Continued)

OTHER PUBLICATIONS

NeutralPosture—Stand Up® Product Brochure © 2010(1 page).

(Continued)

*Primary Examiner* — Rodney B White
(74) *Attorney, Agent, or Firm* — Winston & Strawn LLP

(57) ABSTRACT

A seating assembly is described with a seat member, attached to which is an attachment assembly which can support adjustable arms that support a work surface. The seat member attachment or attachment assembly is includes a plate and a seat mounting assembly. A first adjustable arm is attached to the seat member by a first connecting means. The attachment assembly includes a seat bar member that can be fixed to the seat member and mounting assembly to permit rotation of the adjustable arms around an axis that is perpendicular to the seat member. The mounting assembly has a male component that is adapted to mate with a female component in the first connecting means and a plate member that attaches to the bar member. The first adjustable arm is connected to a second adjustable arm by a second connecting means that allows rotational and pivotal articulation or universal rotation of the second adjustable arm which supports a work surface that is adapted for example for a portable device such as by way of example a computer tablet. The seating device also allows the user to change from a seated to a standing position without removing components from the seating assembly.

6 Claims, 5 Drawing Sheets

(56) References Cited

U.S. PATENT DOCUMENTS

| | | | | | |
|---|---|---|---|---|---|
| 3,813,147 | A | * | 5/1974 | Rick | 297/146 |
| 3,986,263 | A | * | 10/1976 | Borgelt et al. | 433/99 |
| 4,114,274 | A | * | 9/1978 | Jones | 433/33 |
| 4,136,908 | A | * | 1/1979 | Crayne | 297/188.21 |
| 4,249,900 | A | * | 2/1981 | Hoelzer et al. | 433/79 |
| 4,277,102 | A | * | 7/1981 | Aaras et al. | 297/411.36 |
| 4,402,481 | A | * | 9/1983 | Sasaki | 248/282.1 |
| 4,427,382 | A | * | 1/1984 | Hoffmeister et al. | 433/79 |
| 4,453,764 | A | | 6/1984 | Hennessy | |
| 4,458,870 | A | * | 7/1984 | Duncan et al. | 248/279.1 |
| 4,500,134 | A | * | 2/1985 | Kaneko et al. | 297/170 |
| 4,545,555 | A | * | 10/1985 | Koch | 248/280.11 |
| 4,562,987 | A | * | 1/1986 | Leeds et al. | 248/278.1 |
| 4,568,052 | A | * | 2/1986 | Solomon et al. | 248/281.11 |
| 4,590,695 | A | * | 5/1986 | McGillivray | 38/102.2 |
| 4,610,630 | A | * | 9/1986 | Betush | 433/79 |
| 4,645,167 | A | * | 2/1987 | Hardwick | 248/520 |
| 4,659,099 | A | | 4/1987 | Malone | |
| 4,682,749 | A | * | 7/1987 | Strater | 248/284.1 |
| 4,695,024 | A | * | 9/1987 | Haven | 248/281.11 |
| 4,770,384 | A | * | 9/1988 | Kuwazima et al. | 248/281.11 |
| 4,779,922 | A | | 10/1988 | Cooper | |
| 4,783,036 | A | * | 11/1988 | Vossoughi | 248/281.11 |
| 4,836,486 | A | * | 6/1989 | Vossoughi et al. | 248/281.11 |
| 4,863,133 | A | * | 9/1989 | Bonnell | 248/280.11 |
| 4,987,690 | A | * | 1/1991 | Aaldenberg et al. | 40/341 |
| 5,029,941 | A | * | 7/1991 | Twisselmann | 297/411.38 |
| 5,104,073 | A | | 4/1992 | VanBeek et al. | |
| 5,123,621 | A | * | 6/1992 | Gates | 248/281.11 |
| 5,154,390 | A | * | 10/1992 | Bain et al. | 248/447.2 |
| 5,161,812 | A | | 11/1992 | DeWeese | |
| 5,170,975 | A | * | 12/1992 | Chadwick | 248/284.1 |
| 5,275,465 | A | * | 1/1994 | Gulliver et al. | 297/173 |
| 5,311,210 | A | | 5/1994 | O'Brien et al. | |
| 5,348,472 | A | * | 9/1994 | Joeckel et al. | 433/79 |
| 5,369,805 | A | * | 12/1994 | Bergsten et al. | 297/411.35 |
| 5,452,950 | A | | 9/1995 | Crenshaw et al. | |
| 5,476,304 | A | * | 12/1995 | Gulliver et al. | 297/173 |
| 5,490,710 | A | | 2/1996 | Dearing et al. | |
| 5,538,214 | A | * | 7/1996 | Sinila | 248/278.1 |
| 5,564,779 | A | * | 10/1996 | Tolbert et al. | 297/173 X |
| 5,601,331 | A | * | 2/1997 | Austin et al. | 297/170 |
| 5,641,191 | A | * | 6/1997 | Jia | 296/97.6 |
| 5,653,499 | A | * | 8/1997 | Goodall | 297/170 |
| 5,743,503 | A | * | 4/1998 | Voeller et al. | 248/284.1 |
| 5,755,650 | A | * | 5/1998 | Urso | 482/138 |
| 5,765,911 | A | * | 6/1998 | Sorenson | 297/173 |
| 5,779,209 | A | * | 7/1998 | Rello | 248/278.1 |
| 5,893,607 | A | | 4/1999 | Trimnell | |
| 5,909,864 | A | * | 6/1999 | Wang | 297/173 X |
| 5,961,134 | A | | 10/1999 | Congleton et al. | |
| 6,095,607 | A | | 8/2000 | Wenzel | |
| 6,131,868 | A | * | 10/2000 | Welling et al. | 248/276.1 |
| 6,135,548 | A | | 10/2000 | McGuire | |
| 6,142,571 | A | | 11/2000 | Benden | |
| RE36,978 | E | | 12/2000 | Moscovitch | |
| 6,209,835 | B1 | * | 4/2001 | Walrath et al. | 248/276.1 |
| 6,220,663 | B1 | | 4/2001 | Benden et al. | |
| 6,290,295 | B1 | | 9/2001 | Benden et al. | |
| 6,296,312 | B1 | | 10/2001 | Congleton et al. | |
| 6,375,259 | B1 | * | 4/2002 | Ma | 297/170 X |
| 6,409,134 | B1 | * | 6/2002 | Oddsen, Jr. | 248/274.1 |
| 6,412,738 | B1 | * | 7/2002 | Bressler et al. | 297/173 X |
| 6,422,646 | B1 | * | 7/2002 | McNally | 297/170 |
| 6,439,657 | B1 | * | 8/2002 | Tholkes | 297/135 X |
| 6,520,587 | B2 | * | 2/2003 | Noiseux | 297/173 X |
| 6,604,786 | B1 | | 8/2003 | Benden et al. | |
| 6,607,246 | B1 | | 8/2003 | Benden | |
| 6,609,691 | B2 | * | 8/2003 | Oddsen, Jr. | 248/278.1 |
| 6,644,748 | B2 | * | 11/2003 | Tholkes et al. | 297/135 X |
| 6,695,270 | B1 | * | 2/2004 | Smed | 248/274.1 |
| 6,702,373 | B2 | * | 3/2004 | Rossko | 297/173 |
| 6,736,364 | B2 | * | 5/2004 | Oddsen, Jr. | 248/585 |
| 6,834,837 | B2 | * | 12/2004 | Schilt et al. | 248/284.1 |
| 6,877,812 | B2 | | 4/2005 | Congleton et al. | |
| 6,916,065 | B2 | * | 7/2005 | Park | 297/135 X |
| 7,032,965 | B2 | * | 4/2006 | Howell et al. | 297/16.1 |
| 7,036,886 | B2 | | 5/2006 | Benden et al. | |
| 7,048,236 | B2 | | 5/2006 | Benden et al. | |
| 7,104,606 | B2 | | 9/2006 | Congleton et al. | |
| 7,124,755 | B2 | * | 10/2006 | Van Hooser | 128/845 |
| 7,134,719 | B2 | * | 11/2006 | Moglin et al. | 297/170 X |
| 7,207,537 | B2 | * | 4/2007 | Hung | 248/284.1 |
| 7,338,022 | B2 | * | 3/2008 | Hung et al. | 248/278.1 |
| 7,364,127 | B2 | * | 4/2008 | Huang | 248/276.1 |
| 7,410,138 | B2 | * | 8/2008 | Parsons | 248/278.1 |
| 7,434,769 | B1 | * | 10/2008 | May | 248/49 |
| 7,546,994 | B2 | * | 6/2009 | Altonji et al. | 248/276.1 |
| 7,694,927 | B2 | * | 4/2010 | Chuang | 248/276.1 |
| 7,828,252 | B2 | * | 11/2010 | Parsons | 248/125.1 |
| 8,102,331 | B1 | | 1/2012 | Moscovitch | |
| 8,235,342 | B2 | * | 8/2012 | Pfister et al. | 248/292.14 |
| 8,474,771 | B2 | * | 7/2013 | Ross | 248/276.1 |
| 2005/0230585 | A1 | * | 10/2005 | Hung | 248/278.1 |
| 2006/0060735 | A1 | * | 3/2006 | Oddsen et al. | 248/278.1 |
| 2012/0068504 | A1 | * | 3/2012 | Ting | 297/135 |

OTHER PUBLICATIONS

Neutral Posture® Sit/Stand Workstation for Office or Industry, Neutral Posture Ergonomics, Inc. © (P11,699) 2010 (2 pages).

Ergorest, Providing High-Quality Products to Enhance Your Comfort, Safety and Productivity, Ergonomic Design Inc. © 1999 (2 pages).

Give Yourself C.P.R. Comfort Productivity Risk Reduction, Xtension Arm, Cal Trak, Inc. © 1999 (2 pages).

Concerto Manual by CompX ErgonomX (at least as early as Jun. 5, 2013) (2 pages).

Concerto Performance First Manual, CompX ErgonomX (at least as early as 2011, the copyright date on the document) (10 pages).

Levo Deluxe iPad Floor Stand for Tablets Amazon Website print (at least as early as May 31, 2013) (1 page).

TaoTronics® TT-HS01 Easy Adjustable Full-Motion Rotatable Floor Stand, Amazon Website print (at least as early as May 31, 2013) (1 page).

Concerto Change is in the air, CompX ErgonomX (at least as early as 2005, the copyright date on the document) (10 pages).

* cited by examiner

SEATING ASSEMBLY HAVING A SEAT-MOUNTED ATTACHMENT ASSEMBLY FOR ADJUSTABLE EXTENSION ARM

BACKGROUND OF THE INVENTION

1. Field of the Invention

The invention relates to a seating assembly with one or more adjustable extension arms attachable to a seat member of the seating device to hold a support structure adapted to provide a work surface. More particularly, this invention relates to a seating device with an adjustable extension arm assembly that is mounted on the seat member of the seating device to support a portable device such as computer component, tablet computer, or reading material. The seating device allows a user to rotate and pivot the support structure between a horizontal and a vertical stand so as to manipulate the portable device, such as to type on the tablet or to view the screen of the tablet. The seating device also allows the user to change from a seated to a standing position without removing the support structure from the seating device.

2. Description of the Related Art

In the workplace, providing a work station that is user friendly and flexible is important. The increased use of portable devices such as technology-related devices, necessitates work surfaces be adapted to allow the use of said devices for all their intended purposes such as for writing or for reading or inputting information.

In the workplace, persons are often required to perform repetitive manual tasks in a sedentary position. By maintaining a sedentary position throughout the workday, the person can become fatigued without proper support. Remaining in that sedentary position may reduce blood flow through the legs as well. Utilizing ergonomic principles when designing furniture may increase worker productivity, decrease worker fatigue and absenteeism, decrease injuries, improve wellness, and improve blood flow throughout the body.

It is known in the workstation design industry that by varying a person's body position, fatigue is reduced. Without changing positions periodically, proper circulation is hampered. By changing body positions at multiple times throughout the day, a person can reduce stress and increase productivity.

One desirable way of changing body position is for a worker to switch from a seated to a standing position. Alternating from a seated to a standing position facilitates blood flow through the legs, which helps prevent fatigue and improves worker comfort. This sit-and-stand method of reducing worker fatigue is known in the furniture design field.

Several attempts at providing a comfortable work surface for a seated person are known. For example, it is known in the workplace design industry that it is possible to provide keyboard supports for use by a person in a seated position. For example, the approach of Trimnell described in U.S. Pat. No. 5,893,607 utilizes a computer keyboard holder attached to a chair. Trimnell's keyboard holder attaches to the chair legs, and is for use by a person in the seated position, not the standing position. Alternatively, U.S. Pat. No. 4,779,922 to Cooper describes a chair with a built-in computer workstation. U.S. Pat. No. 5,104,073 to VanBeek describes the holder in front of a chair to reduce the chance of the user incurring repetitive stress injuries. U.S. Pat. No. 5,452,950 to Crenshaw describes a school desk computer workstation, while Dearing (U.S. Pat. No. 5,490,710) describes the holder built into a chair arm.

Commercial products such as X-TENSION ARM by Cal Trak, Inc. of Broomfield, Colo., and ERGOREST by Ergonomic Design, Inc. of Northglenn, Colo., are available which provide for the attachment of a keyboard support to a chair, the support being mounted at a given height for a seated user. It is also known to use flexible tubing arms for holding a support structure such as in a desk lamp. However, known commercially-available flexible tubing lacks structural rigidity and has been shown not to be able to hold a support structure. However, if flexible technology improves, utilizing flexible technology could be used in an embodiment of this invention, as would be realized by one of ordinary skill in the art having the benefit of this disclosure.

In each of these approaches, the holder is designed for one position of a user, generally seated. None describe a system for providing a support for use by a person standing near a chair. Further, when a user is practicing those prior designs, but would like to stand to take advantage of the sit-and-stand principle, modifications to the work area would be required. For instance, combining two prior design support systems could possibly be used to accommodate different user positions.

It is known to provide two computer apparatus supports at one workstation: one permanently mounted at a height suitable to a person in a seated position, and one permanently mounted at a height suitable to a person in a standing position. However, the addition of another piece of furniture in the work area is not desirable in many space-limited workplace designs. Further, the same keyboard, mouse, and/or computer may be utilized by multiple workers throughout the day. Therefore, it is desirable to have accessory supports, which are capable of adjusting to the different depths, angles, and heights to accommodate the differently-statured individuals who may utilize the same computer support.

It is known to provide adjustable, full-motion rotatable floor stands for tablet computers, which are free-standing, separate accessories for use by a person in a chair, in bed, or on a couch. Commercial products include the T0-HS01 Easy Adjustable Full-Motion Floor Stand by TAO TRONICS® and the Deluxe Floor Stand for Tablet Computers by LEVO. However, some of these devices are not compliant with workplace industry standards such as BIFMA (Business and Institutional Furniture Manufacturers Association), and therefore it is advantageous to have portable device attachable to a seating assembly to minimize the amount of furniture in the workspace, as described above.

It is also known to provide one device that is mountable to a chair at various locations, such that the sit-and-stand principle may be employed. For instance, U.S. Pat. No. 6,604,786 to Benden et al., issued Aug. 12, 2003, incorporated by reference in its entirety herein (and commonly-owned by the present assignee, Neutral Posture, Inc. of Bryan, Tex.) describes using a support apparatus that is removably attachable to an armrest of a chair, the back of a chair, or to a desk. In this way, accessories, such as a computer, keyboard, and/or a mouse, can be utilized by a person seated in the chair or standing near the chair. When the apparatus is attached to the back of the chair, the apparatus may be utilized by a person in a standing position. The height of the apparatus may be adjusted by adjusting the height of the chair.

It is also known to provide a vertical adjustment apparatus for a keyboard, such that the sit-and-stand principle may be employed. For instance, U.S. Pat. No. 7,048,236 to Benden et al., issued May 23, 2006, incorporated by reference in its entirety herein, (and commonly-owned by the present assignee, Neutral Posture, Inc. of Bryan, Tex.) describes using a support apparatus for a keyboard that is attachable to a workstation and operates to selectively raise and lower a device such as a keyboard such that the device may be utilized by a user in a seated position as well as by the user in a standing position. Commercial products, such as the STANDUP® workplace accessory, provides methods of adjusting for height of a keyboard for a sit-and-stand workstation.

It is also known to provide some keyboard adjustment through the use of an industry-standard keyboard mechanism, such as those provided by CompX Waterloo Inc., Kitchener, Ontario, Canada, for example. The prior art keyboard mechanism systems may provide sufficient adjustment of a keyboard for a seated user, in some situations. However, the adjustability of prior art units may be limited such that the same equipment may not be utilized in conjunction with the sit-and-stand principle described above—at least not to the degree as dictated for an ergonomically-correct standing height of a 95th percentile male.

It is known to provide an articulated support arm for a computer accessory or a tablet computer, which is attached to a workstation, such as the Concerto arm obtained from CompX ErgonomX. However, it would be beneficial to provide such a device to be attachable directly to a seat of a seating device, especially a seat that is height-adjustable, such that the benefits discussed above can be achieved.

Thus, it would be desirable to have a seating device that would have an apparatus attached to the seat of the seating device, and to be capable of elevating a portable device such as a computer or a computer tablet or other technological accessory or reading material for utilization by a user in a seated position and in a standing position. It would be desirable to have a work surface in which tablet portable device can either be positioned in a horizontal plane to allow typing by the user or at a vertical angle so as to allow reading from said device. It would also be desirable that the unit be able to be installed on a seat member of the seating device for practical and functional reasons. It is therefore desirable that the attachment mechanism be simple to use so that the user can change positions and the height of the portable device as desired.

SUMMARY OF THE INVENTION

In one aspect, the current invention provides a seating assembly with a seat member, a first adjustable arm rotationally attached to the seat member by a first connecting means, an attachment assembly for removably attaching a first adjustable arm to the seat member, a second adjustable arm attached to the first adjustable arm by a second connecting means such that the first and second connecting means permit the second adjustable arm to be pivoted and rotated to any desired position; and a support structure attached to the second adjustable arm by a third connecting means such that the support structure is adapted to provide a work surface. In an embodiment of the invention, the second connecting means could provide a universal adjustment to the second adjustable arm. In a further embodiment of the invention, the attachment assembly comprises a bar member (or a seat mount bar) and a mounting assembly. The mounting assembly may be attached to the right or the left side of the bar member so as to permit the use of the seating device by a left-handed or a right-handed user. Alternatively the seating assembly may have two mounting assemblies on either side of the seat member. In a preferred embodiment, the mounting assembly includes a plate attachable to the bar member of the attachment assembly and a male component adapted to mate with a female component of the first connecting means. In a preferred embodiment, the male and female components are tubular in shape such that the female component rotates around the male component. In other embodiments, the male component may comprise a sphere, and the female component may include a complementary surface. The second and third connector means may include a hinge and a spring to allow the pivotal as well as the rotational movement of the second adjustable arm and the support structure. The support structure provides a work surface for a portable device such as by way of example a computer component, a tablet computer, or reading material such as books. In a further embodiment, the second connecting means is adapted to permit a universal adjustment of said second adjustable arm.

In an alternate embodiment, a seating assembly is described to which adjustable arms that support a work surface are attached. The seating assembly includes a seat member and a base member. The seat member is attached to a first adjustable arm by an attachment assembly and by a first connecting means that includes a mounting assembly to permit rotation of the adjustable arms. The first adjustable arm is connected to a second adjustable arm by a second connecting means that may include a hinge. The second connecting means allows rotational and pivotal articulation of the second adjustable arm which supports a work surface that is adapted by way of example for a computer such as a tablet. In an embodiment of the invention, the attachment assembly includes a bar member and a mounting assembly such that the mounting assembly has a plate member and a male component that is adapted to mate with a female component that may be located on the first connecting means.

In an alternate embodiment, the present invention provides a seating assembly including a base structure and a seat structure and that further includes one or more adjustable arms such that at least one of the adjustable arms is functionally attached to a support structure adapted to support one or more portable devices. The seat member includes and attachment assembly for removably attaching a first adjustable arm to the seating member. The attachment assembly includes a seat mount assembly, a plate, and a female component of a first adjustable arm. The attachment means includes a male component of a first connecting means, and the first adjustable arm includes a female component adapted to be functionally associated with the male component of the attachment assembly so as to rotatably connect the first adjustable arm to the attachment assembly. The first connecting means permits the first adjustable arm to rotate about a vertical axis through the first connecting means wherein the vertical axis is substantially perpendicular to the plane defined by the seat member.

The seating assembly also includes a second adjustable arm functionally attached to the first adjustable arm by a second connecting means that permits a rotational and a pivotal movement of the second arm and a support structure attached to the second adjustable arm by a third connecting means that is functionally adapted to permit rotational and a pivotal movement of the support structure. The second connecting means and/or third connecting means may comprise a hinge and/or a spring.

The support structure is functionally adapted to hold a portable device at an adjustable height above the seating device wherein the predetermined height may be adjusted from a first height to accommodate a user utilizing the device in a seated position, to a second height to accommodate the user in a standing position. The support structure also allows adjusting the work surface from a horizontal to a vertical position to accommodate for the various uses of the portable device such writing, reading or inputting information. In a further embodiment, the seating assembly has one or more mounting assemblies attached to the right or the left of the seat member so as to permit the use of the seating assembly by a left-handed or right-handed user.

In another embodiment, the attachment assembly may comprise a slidable attachment assembly which advantageously allows for adjustment of the width of the relevant components.

Figure 1:
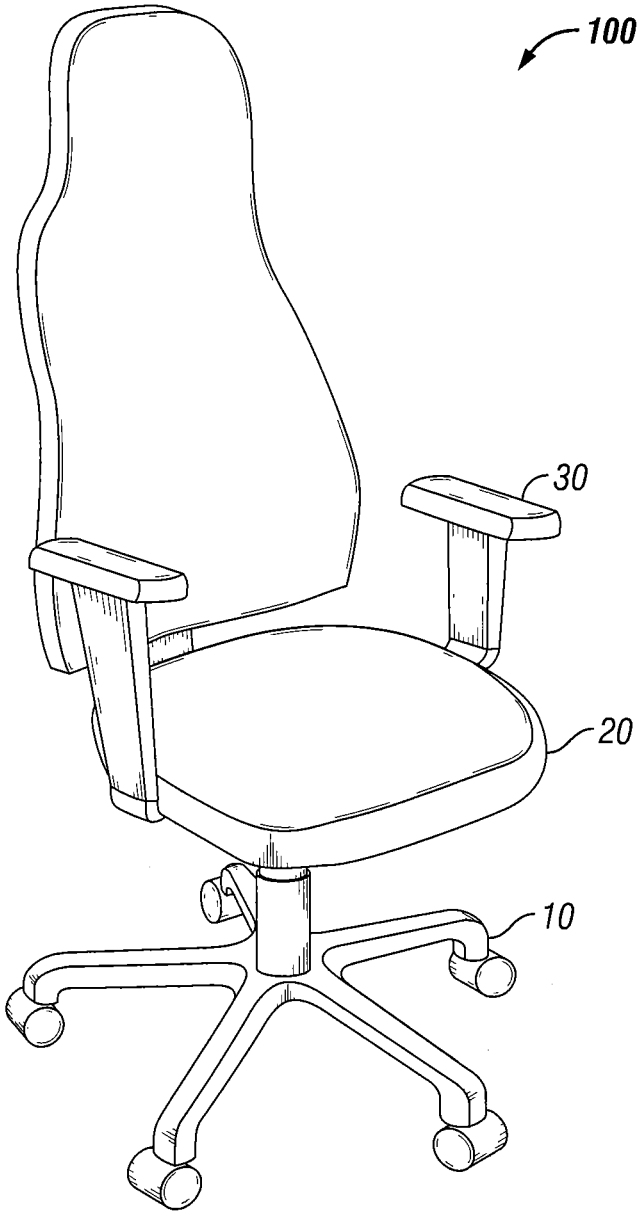
FIG. 1 (Prior Art)
FIG. 1 shows a seating assembly such as a chair of the prior art with a seat member, armrests, back support and a base.

While the invention is susceptible to various modifications and alternative forms, specific embodiments have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DESCRIPTION OF ILLUSTRATIVE EMBODIMENTS

The invention relates to a seating assembly with an extension arm that is attachable to the bottom of a seat member to support a work surface. The extension arm includes one or more adjustable arms to allow the use of the work surface by a user or operator in both a seated and standing position as desired. The extension arm also allows the use of the work surface to support a portable device such as a computer tablet or other computer accessories in a horizontal or vertical position so as to permit the use of the tablet to type or read. According to the present invention, the seating assembly can be adjusted to provide a work surface for a left handed and/or a right handed user, or both if the seating assembly is used by multiple persons, by easily altering components in the novel attachment assembly described more fully herein. Further, by having the extension arm attachable to the bottom of the seat member, as the height of the seat member is adjusted, the height of the arm and thus the portable device such as a computer tablet, is also further adjustable. Additional height adjustment is provided in the first connecting means, as described more fully below, which advantageously provides flexibility and facilitates practicing proper ergonomic principles while utilizing the seating device. Further, by attaching the arm to the seat member, no additional stand-alone apparatus is required to be placed in the workspace. Advantageously, with the improvements described herein, none of the functions of the prior art seating device is hindered.

The invention relates particularly to a seating assembly having an extension arm affixed to the seating device by a mounting assembly. The mounting assembly may be attached to the seat member of the seating assembly by a seat mount bar or bar member affixed to the bottom part of the seat member preferably in a horizontal orientation. The mounting assembly includes a plate and a male component. The male component is configured to mate with a female component of a connection means linking the mount assembly (and hence the seat member) to the extension arm such that the female component rotates around the male component to allow the rotational movement of the extension arm. In an embodiment of the present invention, the male and female components are tubular. Certain embodiments of the present invention may have one or more mounting assemblies so to permit connecting the extension arm to the right and/or the left side of the seat member.

The extension arm in an embodiment of the invention includes a first adjustable arm, a second adjustable arm and a support structure as described more fully below.

The support structure maybe adapted to hold any portable device, such as a computer, a tablet computer, a book, etc so as to allow the ergonomic use of said portable device. The support structure is mounted on the second adjustable arm by a third connector means.

In each of these embodiments, the advantage of using one piece of furniture to support the work surface while the user is seated or standing is utilized, with a further advantage of having the seat attachment member attachable to the seat member directly, as opposed to being attached to neighboring apparatus or resting on the floor. Thus, cost and space is reduced compared to using two pieces of furniture such as separate seating devices and desks to employ the sit-and-stand principle.

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Further aspects and advantages of the various embodiments of the invention will become apparent from consideration of the following description and drawings.

Referring to FIG. 1, a prior art a seating assembly 100 is shown having a seat member 20 and a base 10. Seat member 20 is used as a general term through this specification to comprise the seat, and can include the seat mechanism (springs, knobs, brackets, associated housing) which provides for the basic functionality of a prior art chair (pivoting, rotating, etc.). Armrests 30 are also shown in this prior art seating assembly 100 but are not included in the remaining figures for simplicity. However, it would be realized by one of ordinary skill in the art that each seating assembly 100 shown herein may include armrests 30.

Figure 2:
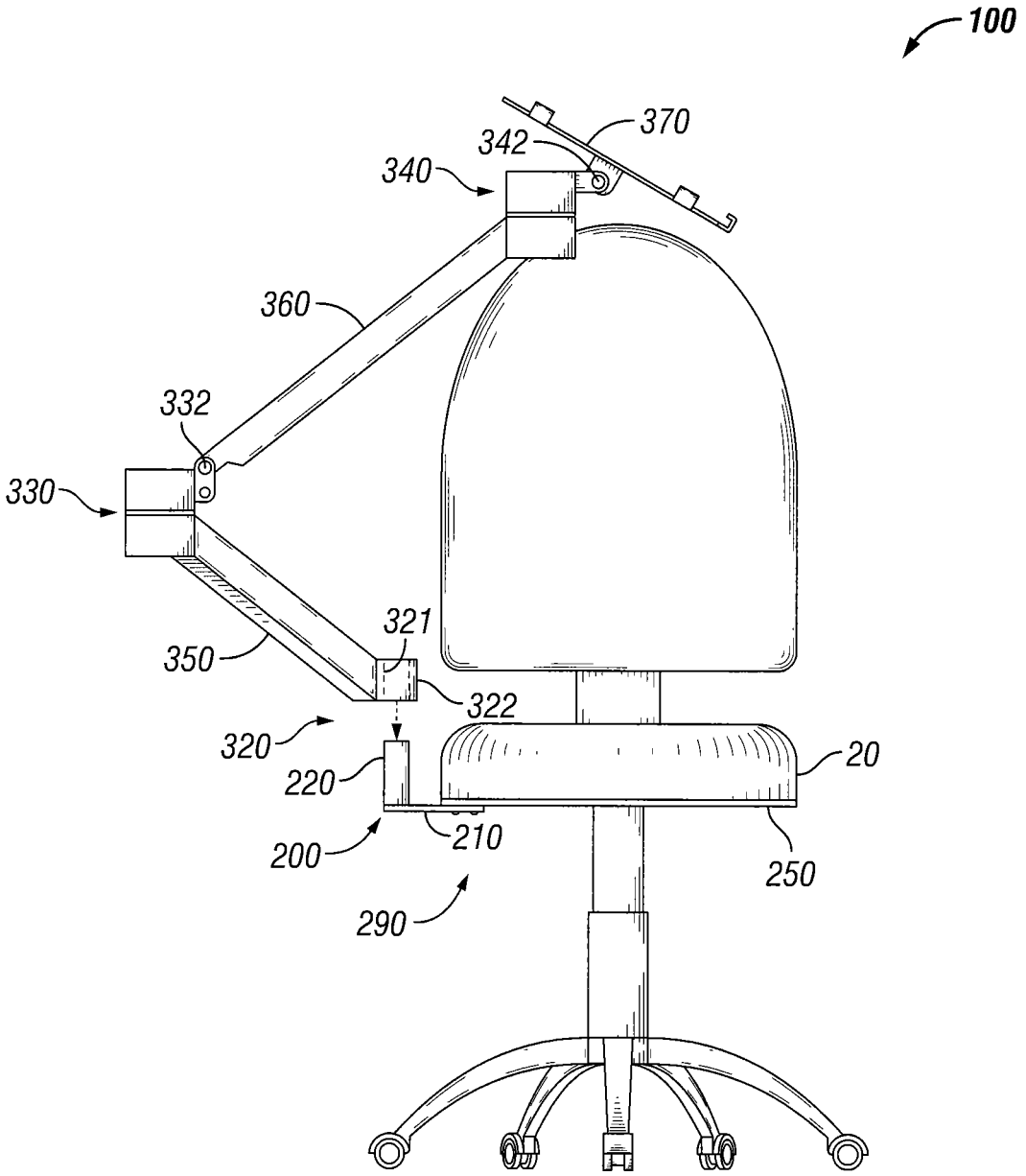
FIG. 2 depicts an embodiment of the seating assembly of the present invention showing a seat mount bar (or bar member), a mounting assembly, connecting means, adjustable arms and support structure.

Referring to FIG. 2, a seating assembly 100 is shown that has a seat member 20. An attachment assembly 290 is shown as comprising a seat mount bar or bar member 250 and a mounting assembly 200. Mounted underneath seat member 20 (which includes the seat mechanism but is shown simply as seat member 20 in the figures) is the bar member 250. As shown more fully in FIG. 3A, the bar member 250 has holes 255 and is also attachable to the plate 210 of the mounting assembly 200. The mounting assembly 200 includes a plate 210 and male component 220. The male component 220 is configured to mate with female component 322 of an accessory, such as on a first adjustable arm, described more fully below. It can be seen in FIG. 2 that female component 322 includes a cylindrical void 321 adapted to receive the male component 220. In FIG. 2, the female component 322 is separated from the male component 220; however, as shown by the directional arrow, the female component is adapted to receive male component 220.

In this embodiment, it can be seen that an attachment assembly 290 includes the mounting assembly 200 (i.e. the male component 220 connected to the plate 210) and bar member 250. The male component 220 is pressed into place and secured within the plate 210. However, other configurations could be utilized as one of ordinary skill in the art would realize. For instance, the entire attachment assembly 290 (i.e. the mounting assembly 200 and the bar member 250) could comprise one singular unit, welded together or casted into a single component, by way of example only. Other well-known methods of constructing the attachment assembly 290 would be well-known to others, having the benefit of this disclosure. Further, the mounting assembly could include a female component 322 instead of the male component 220 as described more fully hereinafter.

Referring to FIG. 2, the first adjustable arm 350 is functionally associated with the female component 322 having void 321. The female component 322 is adapted to receive the male component 220 of the seat mounting assembly 200. In that way, the male component 220 of the seat mounting assembly 200 and the female component 322 form a first connector means 320 to rotatably attach the first adjustable arm 350 to the mounting assembly 200. These first connector means 320 allows for the rotational movement of the first adjustable arm 350 to rotate about a vertical axis of the male component 220, wherein the vertical axis is substantially perpendicular to the plane defined by seat member 20. Further, in some embodiments, the female component 322 may be selectively attached at a first height around the male component 220, and then released and selectively attached at a second height around the male component 220 at a second height above the first height. The selective attachment may be provided by the tightening of a collar on the female component, by way of example only. Regardless, this additional feature of selective attachment at different heights advantageously provides another mechanism in which the height of the arm may be adjusted.

It would be realized by one of ordinary skill in the art that in other embodiments, the male component 220 may be attached to the first adjustable arm 350 and the female component 322 could be part of the mounting assembly 220. That is, the male and female components 220 and 322 comprise the first connector means, regardless of which is connected to the first adjustable arm 350, the other being part of the mount assembly 200.

Again referring to FIG. 2, a second adjustable arm 360 is shown connected to first adjustable arm 350 by second connector means 330. Second connector means 330 allows the rotational and pivotal movement of second adjustable arm 360 and can include a spring to adjust the tension in the adjustable arm 360, if needed, as would be realized by one of ordinary skill in the art. The pivotal movement of the second connector means is provided by hinge 322, which allows the upper end of the second adjustable arm to be moved vertically with respect to the second connector means 330. Rotational movement of the second adjustable arm with respect to the first adjustable arm is provided by the mating of two concentric components may include a bearing (each not shown), as would be realized by one of ordinary skill in the art having benefit of this disclosure. Second adjustable arm 360 connects to support structure 370 by a third connector means 340. Third connector means 340 allows the rotational and pivotal movement of support structure 370. Rotational movement of the third adjustable arm with respect to the second adjustable arm is provided by the mating of two concentric components may include a bearing (each not shown), as would be realized by one of ordinary skill in the art having benefit of this disclosure. Support structure 370 may pivot vertically via hinge 372 and rotate around an axis that is substantially perpendicular to the plane defined by seat member 20 so as to allow a portable device (not shown), a computer accessory, a computer tablet or a book to be used in a landscape or in a portrait orientation.

Figure 4:
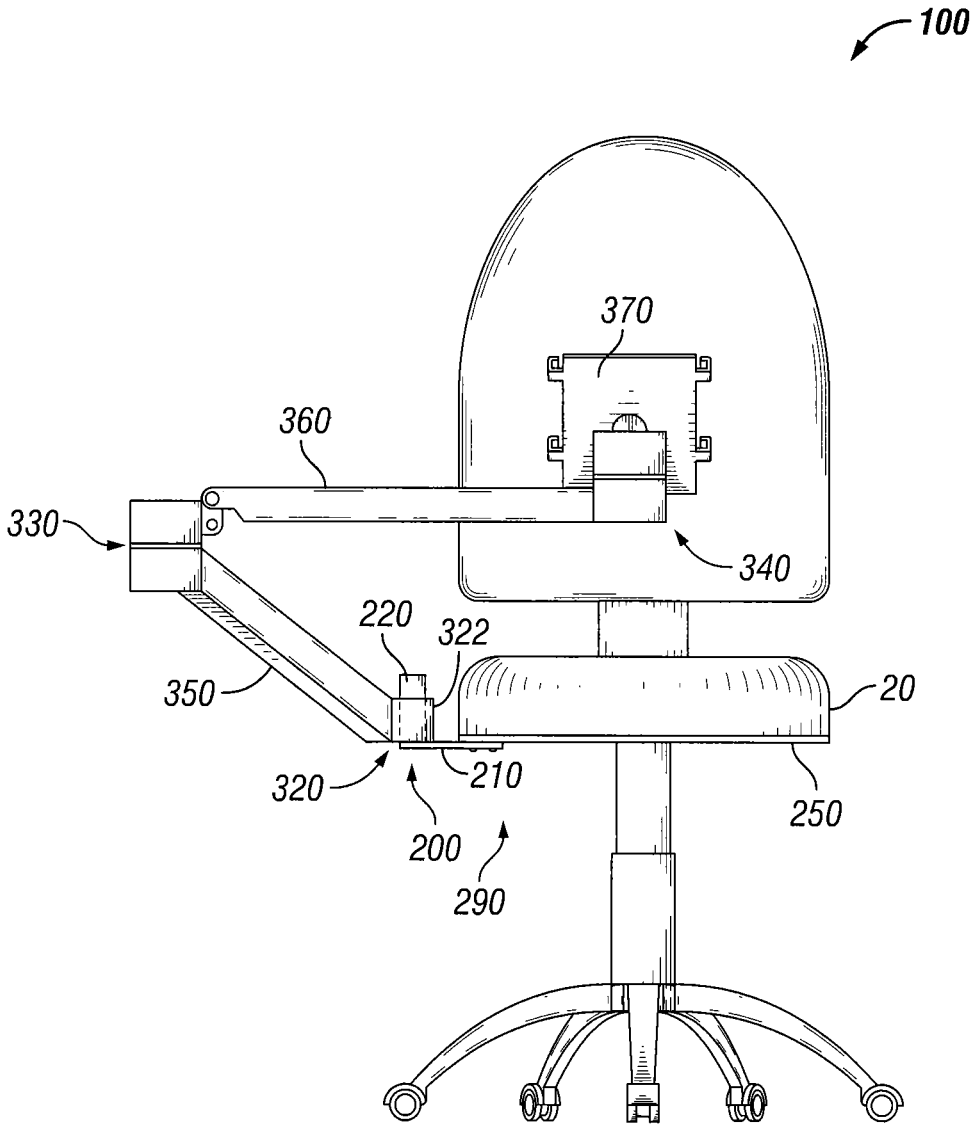
FIG. 4 shows a seating assembly according to the present invention with the second adjustable arm extended horizontally.

Referring again to FIG. 2, once the female component 322 is inserted into the male component 220, it can be seen that a user would be able to utilize the portable device while standing. It is noted that FIG. 4 is provided in which a user of the claimed device can utilize the present invention while seated, thereby realizing the advantages of the sit-and-stand principle described above.

Figure 3A:
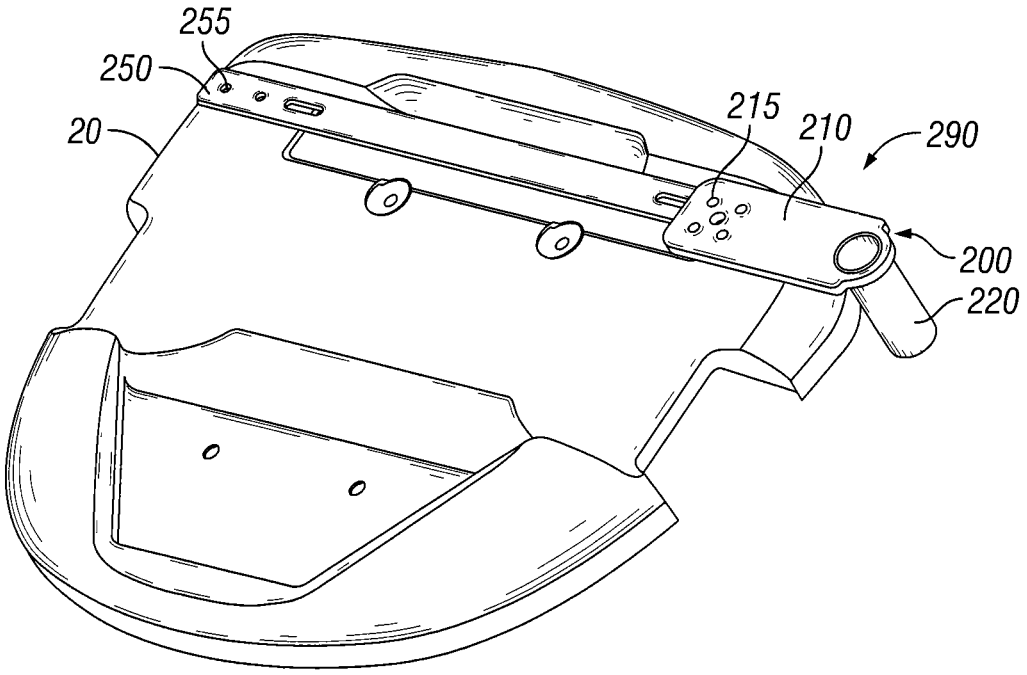
FIG. 3A is a bottom perspective view of an embodiment of the seat member of a seating assembly according to the present invention showing the attachment of a bar member and a mounting assembly.

By attaching the claimed device to the seat member 20 of the prior art seating assembly 100, advantageously no additional furniture is required in a workspace. Further, since most seat members 20 of prior art seating assemblies 100 are adjustable for the height of the user, then by adjusting the height of the seats, then adjustment of the height of the support structure is similarly adjustable, which is advantageous over prior art units. Further, by adding the attachment assembly 290 to the seat member 20 of the seating assembly 100, the adjustable arm can be added or removed from the seating assembly without the use of tools. Further, since the attachment assembly 290 includes a simple yet robust means to connect that arm to the seat member 20 via the first connecting means 320, the arm can be removed quickly and stored when not in use. Referring to FIG. 3A, the bottom view of an example of seat member 20 is shown. Attached to seat member 20 is attachment assembly 290, which includes the seat mount bar or bar member 250 and the mounting assembly 200. In an embodiment of the invention shown, the bar member 250 is attached to the bottom of the seat member 20. As shown, the bar member 250 is rectangular and fixed to seat member 20 by screws. It is understood by the skilled in the art that any method of attaching seat member 20 to bar member 250 may be employed, such as by welding, gluing, etc. It is also noted that while the mount assembly 200 is attached to the right-hand side of the seat mount bar 250 as shown, one of ordinary skill in the art can realize that the mounting assembly 200 is equally attachable to the left-hand side of the bar member 250, which allows the claimed device to be utilized by a left-handed or right-handed user.

Figure 3B:
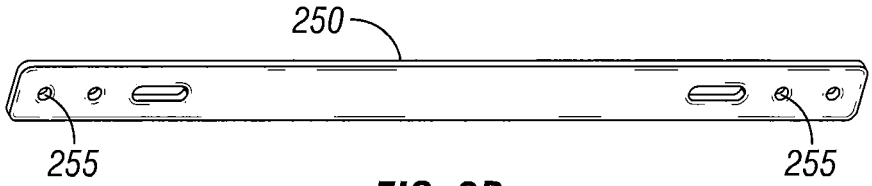
FIG. 3B shows a bar member in isolation.

FIG. 3B shows in isolation an example of bar member 250, bar member 250 is shown as rectangular in shape. However, it is understood that any shape, such as a rod for example, may be used that would allow attaching the bar to seat member 20 and to mounting assembly 200. Regardless, it is readily apparent that the mounting assembly can be attached to either end of the seat mount bar 250.

Figure 3C:
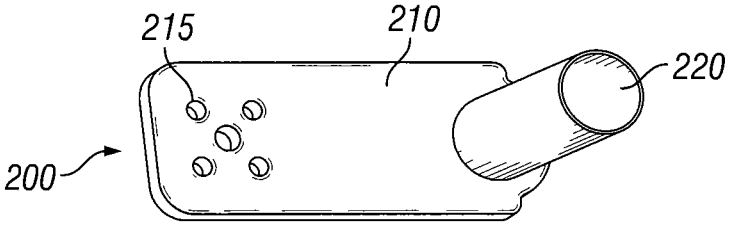
FIG. 3C shows a mounting assembly in isolation with a male component and a plate.

FIG. 3C shows, in isolation, an example of mounting assembly 200. Mount assembly 200 includes plate 210 and male component 220. Plate 210 secures mounting assembly 200 to either end of the bar member 250 using screws inserted through plate holes 215. Further, in one embodiment, the male component 220 is a metal tube that is pressed into plate 210 and is then welded in place. However, other methods of construction could be used to provide the functional equivalent of the structure of the mount assembly 220. Further, it would be understood by the skilled in the art that any method of attaching plate 210 to either end of the bar member 250 may be employed, such as by welding, nuts and bolts, etc. Plate 210 is shown as rectangular in shape. However, it is understood that plate 210 can be configured in more than one shape as long as it allows the proper fastening and securing of the mount assembly 200 to the mount seat bar 250.

It should be noted that the aforementioned inventive seat member attachment 290 comprises the bar member 250 of FIG. 3B and the mount assembly 200 of FIG. 3C.

Referring to FIG. 4, shown is the seating assembly 100 in accordance with FIG. 2 of the present invention, in which the support structure 370 is been rotated and lowered such that the support structure 370, which could be supporting a portable device for example, would be accessible to a user seated in the seating assembly 100. As shown, and as compared to FIG. 2, the first adjustable arm 350 is rotatable with respect to the mounting assembly 200 via the first connecting means 320, the second adjustable arm 360 has been rotated with respect to the first adjustable arm 350 via the second connecting means 330, the second adjustable arm 360 has been pivoted via the hinge 332 on the second connecting means 330, the support structure 370 has been rotated with respect to the second adjustable arm 360 via the third connecting means 340, and the support structure 370 has been pivoted via the hinge 342 of the third connecting means 340. Thus, the support structure 370 has been lowered, and the second adjustable arm 360 is shown extended substantially horizontally.

It should be mentioned that alternative embodiments, each, any, or all of the first, second, and third connecting means could provide for universal adjustment. For instance the connector means could comprise a ball-and-socket joint between the respective two components (i.e. between the first adjustable arm and the second adjustable arm in the case of the second connecting means) thus allowing rotation about the x, y, and z axes providing for universal adjustment of the second adjustable arm. Similarly, the male component 220, which is shown in the Figures as tubular, of the first connector means could be formed in the shape of a sphere, and the female component 322 of the first connecting means could be provided with a complementary mating spherical surface, thus providing universal (i.e. in the x, y, and z axes) adjustment of the first adjustment arm with respect to the mounting assembly.

The second connecting means could provide for universal adjustment of the second adjustable arm. For instance the first connector means could comprise a ball-and-socket joint thus allowing rotation about the x, y, and z axis providing for universal adjustment of the second adjustable arm 360 with respect to the mount assembly 200. With this configuration, yet another method of altering the height of the support structure is provided. That is, by lowering the first adjustable arm with respect to the seat member 20 via the first connecting means.

Similarly, the third connecting means 340 could comprise a ball on the end of the second adjustable arm 360 mating with a complementary surface on the support structure, thus allowing rotation about the x, y, and z axes providing for universal adjustment of the support structure 370.

In yet another embodiment, the mounting assembly 200 can be attached to the other end of the bar member 250. For instance, in FIG. 2, the mount assembly 200 is shown attached to the left side of the bar member 250. This can also be seen in FIG. 3A, bottom view. However, as can be seen in FIG. 3A, holes 255 are provided on both ends of the bar member 250 such that the mounting assembly 200 could be attached the other end, i.e. the right end in FIG. 2, of the bar member 250, to accommodate left-handed or right-handed persons. Finally, in yet another embodiment, the bar member 250 could include mounting assembly 200 on both ends of bar member 250. When a user wanted to move the arm from a first mounting assembly 200 on the left-hand side of the seat member 200 to a second mounting assembly 250 on the right-hand side of the seat member 200, the user may remove the from the first mounting assembly and attach the arm to the second mounting assembly as would be realized by one of skill in the art having the benefit of this disclosure. In this way, the seating assembly 100 can be advantageously utilized in the same workspace by users desiring different configurations of the seating assembly 100 without addition additional equipment to the work area.

Describing an embodiment of the present invention in operation as shown in FIGS. 2 and 4, seating assembly 100 has a seat member 20. Mounted underneath seat member 20 is a bar member 250 that also attaches to mount assembly 200. Male component 220 of the mount assembly is configured to mate with female component 322 of first connecting means 320. First connector means 320 links the mount assembly 200 to first adjustable arm 350. First connector means 320 allows for the rotational movement of the first adjustable arm 350 to rotate about a vertical axis though first connecting means 320, wherein the vertical axis is substantially perpendicular to the plane defined by seat member 20. Second adjustable arm 360 is connected to first adjustable arm 350 by second connecting means 330. Second connecting means 330 allows the rotational and pivotal movement of second adjustable arm 360. Second adjustable arm 360 connects to support structure 370 by a third connecting means 340. Third connecting means 340 may allow the rotational and pivotal movement of support structure 370. Support structure 370 may pivot vertically and rotate around an axis that is substantially perpendicular to the plane defined by seat member 20 so as to allow a portable device (not shown) such as a computer tablet by way of example to be used in a landscape or in a portrait orientation. And comparing FIG. 2 to FIG. 4, it can be seen that the present invention allows a user to utilize the claimed device in a seated or standing position, thus obtaining the benefits discussed above.

Figure 5A:
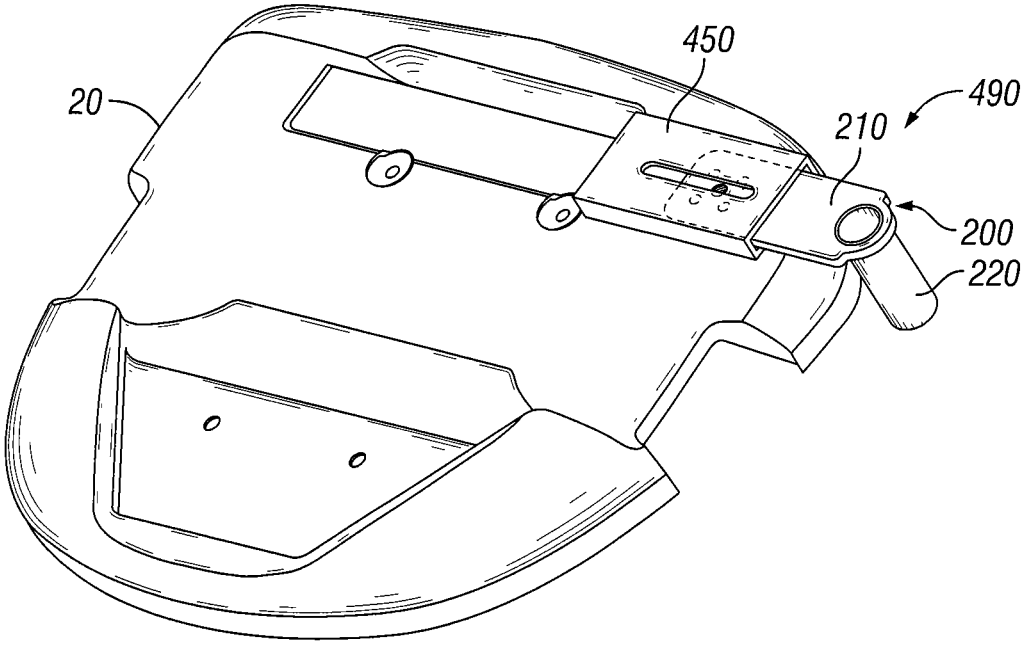
FIGS. 5A and 5B show a seating assembly according to the present invention which includes a slidable attachment assembly.
Figure 5B:
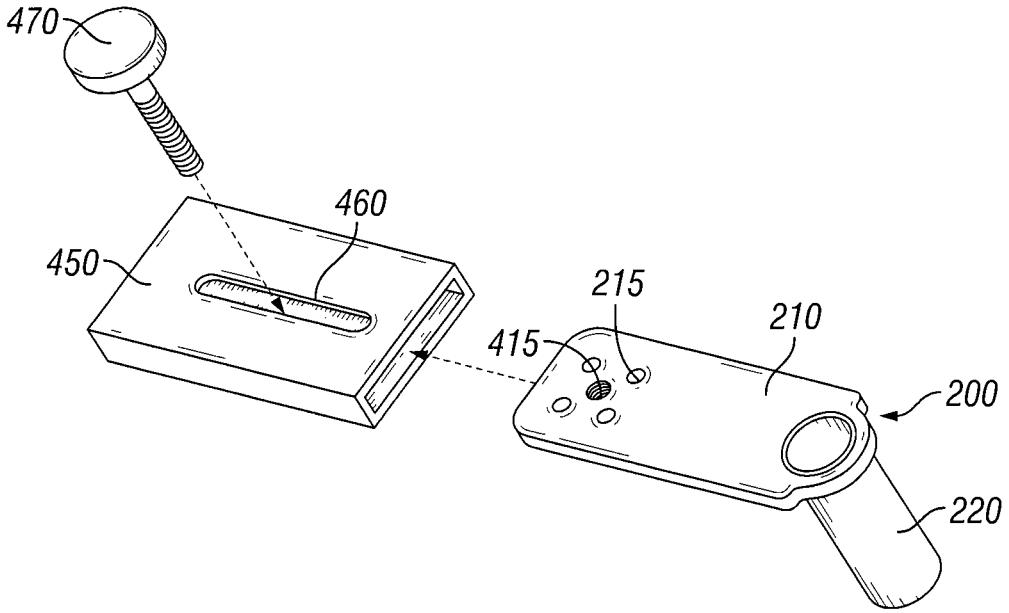

Referring to FIGS. 5A and 5B, another embodiment of the invention is provided showing a slidable attachment assembly 490. The embodiment of FIGS. 5A/B includes many of the same features as the embodiments of FIGS. 2-4, with the differences being described hereinafter. In this embodiment, it can be seen that an slidable attachment assembly 490 includes a mounting assembly 200 and a housing 450. In this embodiment, the mounting assembly 200 is the same as the mounting assembly previously described with the addition of threaded hole 415, the purpose of which will be described below. In this embodiment, housing 450 is a hollow rectangular metal frame which is attachable to the seat member 20, just like the bar member 250 was attachable to the seat member 20. The housing 450 includes a longitudinal opening adapted to slidably receive the mounting assembly 200 in operation. The housing is also provided with a longitudinal slot, shown on its underside in the attached Figures.

Specifically, FIG. 5B shows housing 450 with slot 460. Mounting assembly 200 is shown, which includes the male component 220 connected to the plate 210, holes 215, each of which being described previously, and threaded hole 415. FIG. 5B shows an adjustment knob 470 this is adapted to pass through slot 460 in the housing 450 and threadedly engage hole 415 of the mounting assembly 200. FIG. 5B also shows the housing 450 attached to the seat member 20. As described above, the seat member 20 is used herein a general term and is known to be just the seat, or the seat and seat mechanism which houses the springs, chair adjustments, etc. The mounting assembly 200 is shown slidably disposed within the housing 450. The threaded hole 415 is shown into which the adjustment knob 470 may be inserted.

In operation, the housing 450 is attached to the underside of the seat member 20. The mounting assembly 200 is longitudinally inserted into the housing 450, as shown by the directional arrows in FIG. 5B. Once inserted, the threaded hole 415 of the mounting assembly 200 is aligned with the slot 460, such that a threaded end of the adjustment knob 470 may be inserted. Once a desired width is selected, a user may rotate the adjustment knob 470 until the shoulder on the adjustment knob 470 contacts the housing 450, thus selectively securing the mounting assembly 200 within housing 450. In this way, adjustment for the width of the arms may be advantageously provided.

It should be noted that the remaining features shown in FIG. 2 (i.e. the first and second adjustable support arms, etc.) are the same for the embodiment of FIGS. 5A and B and will not be repeated in this section.

Although various embodiments have been shown and described, the invention is not so limited and will be understood to include all such modifications and variations as would be apparent to one skilled in the art.

The following table lists the description and the reference numbers as used herein and in the drawings attached hereto for use as reference only, and do not limit the scope of the claims in any way.

| Number | Name |
|---|---|
| 10 | Base |
| 20 | Seat Member |
| 100 | Seating Assembly |
| 200 | Mounting Assembly |
| 210 | Plate |
| 215 | Plate holes |
| 220 | Male Component |
| 250 | Seat Mount Bar or Bar Member |
| 255 | Bar Member Holes |
| 290 | Attachment Assembly |
| 300 | Extension Arm |
| 320 | First Connecting Means |
| 322 | Female Component |
| 330 | Second Connecting Means |
| 332 | Hinge of Second Connecting Means |
| 340 | Third Connecting Means |
| 342 | Hinge of Third Connecting Means |
| 350 | First Adjustable Arm |
| 360 | Second Adjustable Arm |
| 370 | Support Structure |
| 415 | Threaded Hole |
| 450 | Housing |
| 460 | Slot |
| 460 | Adjustment Knob |
| 490 | Slidable Attachment Assembly |

What is claimed is:

1. A seating assembly comprising:

a) a seat member;

b) an attachment assembly for removably attaching a first adjustable arm to the seat member, wherein said attachment assembly comprises a slidable attachment assembly having a housing and a mounting assembly, wherein the mounting assembly is slidably engaged in the housing by an adjustment knob passing through a slot in the housing and into a threaded hole in the mounting assembly;

c) the first adjustable arm being rotationally attached to said seat member by a first connecting means;

d) a second adjustable arm attached to said first adjustable arm by a second connecting means, said first and second connecting means permitting said second adjustable arm to be universally adjustable both horizontally and vertically to a desired position; and e) a support structure attached to said second adjustable arm by a third connecting means, wherein said third connecting means permits said support structure to be rotated or pivoted vertically or horizontally to any desired position to provide a work surface.

2. The seating assembly of claim 1, wherein the mounting assembly comprises: a plate and a male member.

3. A seating assembly comprising one or more adjustable arms functionally attached to a support structure at one end of one of said adjustable arms, wherein:

a) said seating assembly comprises a base member and a seat member, said seat member having an attachment assembly for removably attaching a first adjustable arm to said seat member, said first adjustable arm being adjustably connected to said attachment assembly by first connecting means, said first connecting means permitting said first adjustable arm to rotate; wherein said attachment assembly comprises a mounting assembly and a bar member, wherein said mounting assembly further comprises a plate member attached to said bar member, and a male component attached to said plate member, said male component adapted to mate with said female component of said first connector means;

b) a second adjustable arm being functionally attached to said first adjustable arm by a second connecting means, said first and second connecting means permitting said second adjustable arm to be universally adjustable both horizontally and vertically to a desired position; and c) a support structure attached to said second adjustable arm by a third connecting means, wherein said third connecting means permits said support structure to be rotated or pivoted vertically or horizontally to any desired position to provide a work surface facilitating the use of one or more portable devices.

4. The seating assembly of claim 3, wherein the mounting assembly is attached to the right or the left side of the bar member so as to permit the use of said seating device by a left-handed or a right-handed user.

5. A seating assembly including a based structure and a seat structure, said seating assembly further comprising one or more adjustable arms, wherein at least one of said one or more adjustable arms is functionally attached to a support structure adapted to support one or more computer components, wherein:

a) said seat member includes an attachment assembly for removably attaching a first adjustable arm to said seat member, said first adjustable arm including a female component adapted to mate with a male component of said attachment assembly to rotatably connect said first adjustable arm to said attachment assembly, said first connecting means permitting said first adjustable arm to rotate about a vertical axis through said first connector means, said vertical axis being substantially perpendicular to the plane defined by said seat member; wherein said attachment assembly further includes a mounting assembly which includes a bar member, a plate member attached to said bar member, and a male component attached to said plate member, said male component adapted to mate with said female component of said first adjustable arm;

b) a second adjustable arm functionally attached to said first adjustable arm by a second connecting means, said second connecting means permitting said second arm to be universally adjustable both horizontally and vertically to a desired position; and c) a support structure attached to said second adjustable arm by a third connecting means, said third connecting means functionally adapted to permit universal rotational and a pivotal movement of said support structure to a desired position, wherein:

said support structure is functionally adapted to hold a portable device at an adjustable height above the seating device wherein the predetermined height may be adjusted from a first height to accommodate a user utilizing the tablet in a seated position, to a second height to accommodate the user in a standing position.

6. The seating assembly of claim 5, wherein the mounting assembly is attached to the right or the left side of the bar member so as to permit the use of said seating device by a left-handed or a right-handed user.

* * * * *